US005324395A

United States Patent [19]

Paul et al.

[11] Patent Number: 5,324,395

[45] Date of Patent: Jun. 28, 1994

[54] CATHODE FOR USE IN ELECTROLYTIC CELL AND THE PROCESS OF USING THE CATHODE

[75] Inventors: Eric Paul, Northwich; Mary J. Mockford, Chester; Frank Rourke, Northwich; Paul M. Hayes, Stoke-on-Trent, all of England

[73] Assignee: Imperial Chemical Industries, PLC

[21] Appl. No.: 987,968

[22] Filed: Dec. 11, 1992

[30] Foreign Application Priority Data

Dec. 13, 1991 [GB] United Kingdom ..... 9126534
Dec. 13, 1991 [GB] United Kingdom ..... 9126536

[51] Int. Cl.[5] ..... C25B 1/04; C25B 1/70; C25B 11/06

[52] U.S. Cl. ..... 204/98; 204/128; 204/129; 204/242; 204/290 R; 252/518

[58] Field of Search ..... 204/290 R, 242, 129, 204/98, 128; 252/518; 429/44

[56] References Cited

U.S. PATENT DOCUMENTS

| | | | |
|---|---|---|---|
| 4,100,049 | 7/1977 | Brannan | 204/242 |
| 4,465,580 | 2/1979 | Kasuya | 204/290 R |
| 4,543,265 | 2/1984 | Kasuya | 427/34 |
| 4,877,508 | 10/1988 | Morimoto et al. | 204/290 R |
| 5,021,304 | 3/1989 | Ruka et al. | 429/30 |

FOREIGN PATENT DOCUMENTS

| | | | |
|---|---|---|---|
| 1134903 | 11/1982 | Canada | 204/290 R |
| 0031948 | 7/1981 | European Pat. Off. . | |
| 0040097 | 11/1981 | European Pat. Off. . | |
| 0089141 | 9/1983 | European Pat. Off. . | |
| 0129374 | 12/1984 | European Pat. Off. . | |
| 0170149 | 2/1986 | European Pat. Off. . | |
| 0222911 | 5/1987 | European Pat. Off. . | |
| 0405559 | 1/1991 | European Pat. Off. . | |
| 0413480 | 2/1991 | European Pat. Off. . | |
| 1511719 | 5/1978 | United Kingdom . | |
| 1533758 | 11/1978 | United Kingdom . | |
| 1533759 | 11/1978 | United Kingdom . | |
| 1552721 | 9/1979 | United Kingdom . | |
| 2015032 | 9/1979 | United Kingdom . | |

OTHER PUBLICATIONS

Hall et al, Hydrogen Evolution Cathodes With AB-5-Catalyzed Coatings, Inco Alloys International, Inc., pp. 184–194.

Hall, Plasma-sprayed nickel cathode coatings for hydrogen evolution in alkaline electrolytes, Journal of Applied Electrochemistry, vol. 14, 1984, pp. 107–115.

Semenenko et al, Electrochemical Properties of Intermetallic Hydride-Polymeric Binder Composite Electrodes, Plenum Publishing Corporation, 1984, pp. 525–527.

Patent Abstracts of Japan, re: JP-A-54-090-080. Dec. 1977.

Patent Abstracts of Japan, re: JP-A-51-117-181. Oct. 1976.

*Primary Examiner*—Kathryn Gorgos
*Attorney, Agent, or Firm*—Cushman, Darby & Cushman

[57] ABSTRACT

Durable low hydrogen over-voltage cathodes bearing a coating which has an outer layer which comprises at least 10% cerium oxide by XRD and at least one non-noble Group 8 metal. Such cathodes may be prepared by a process involving at least the steps of coating a metallic substrate with an interim coating comprising cerium oxide and at least one non-noble Group 8 metal by plasma spraying an intermetallic compound of cerium and nickel and heating the interim coating in a non-oxidizing atmosphere.

8 Claims, 1 Drawing Sheet

CATHODE FOR USE IN ELECTROLYTIC CELL AND THE PROCESS OF USING THE CATHODE

BACKGROUND OF THE INVENTION

1. Field of the Invention

This invention relates to a cathode for use in an electrolytic cell, and in particular to a cathode which has a low hydrogen over-voltage when used in the electrolysis of water or aqueous solutions, for example aqueous alkali metal chloride solutions.

2. Background of Related Art

The voltage at which a solution may be electrolyzed at a given current density is made up of and is influenced by a number of features, namely the theoretical electroyzing voltage, the over-voltages at the anode and cathode, the resistance of the solution which is electrolyzed, the resistance of the diaphragm or membrane, if any, positioned between the anode and cathode, and the resistance of the metallic conductors and their contact resistances.

As the cost of electrolysis is proportional to the voltage at which electrolysis is effected, and in view of the high cost of electrical power, it is desirable to reduce the voltage at which a solution is electrolyzed to as low as a value as possible. In the electrolysis of water or aqueous solutions--, --; there is considerable scope for achieving such a reduction in the electrolyzing voltage by reducing the hydrogen over-voltage at the cathode.

There have been many prior proposals of means of achieving such a reduction in hydrogen over-voltage.

For example, it is known that the hydrogen over-voltage at a cathode may be reduced by increasing the surface area of the cathode, for example by etching the surface of the cathode in an acid, or by grit-blasting the surface of the cathode, or by coating the surface of the cathode with mixture of metals, for example a mixture of nickel and aluminium, and selectively leaching one of the metals, for example aluminium, from the coating.

Other methods of achieving a low hydrogen over-voltage cathode which have been described involve coating the surface of a cathode with an electrocatalytically-active material which comprises a platinum group metal and/or an oxide thereof. Examples of such prior disclosures include the following.

U.S. Pat. No. 4,100,049 discloses a cathode comprising a substrate of iron, nickel, cobalt or alloys thereof and a coating of a mixture of a precious metal oxide, particularly palladium oxide, and a valve metal oxide particularly zirconium oxide.

British Patent 1511719 discloses a cathode comprising a metal substrate, which may be ferrous metal, copper or nickel, a coating of cobalt, and a further coating consisting of ruthenium.

Japanese Patent Publication 54090080 discloses pretreating an iron cathode with perchloric acid followed by sinter coating the cathode with cathode active substances which may be ruthenium, iridium, iron or nickel in the form of the metal or a compound of the metal.

Japanese Patent Publication 54110983 discloses a cathode, which may be of mild steel, nickel or nickel alloy, and a coating of a dispersion of nickel or nickel alloy particles and a cathode activator which comprises one or more of platinum, ruthenium, iridium, rhodium, palladium or osmium metal or oxide.

Japanese Patent Publication 53010036 discloses a cathode having a base of a valve metal and a coating of an alloy of at least one platinum group metal and a valve metal, and optionally a top coating of at least one platinum group metal.

European Patent 0 129 374 describes a cathode which comprise a metallic substrate and a coating having at least an outer layer of a mixture of at least one platinum group metal and at least one platinum group metal oxide in which the platinum group metal in the mixture with the platinum group metal oxide comprises from 2% to 30% by weight of the mixture.

SUMMARY OF THE INVENTION

The present invention relates to a cathode for use in an electrolytic cell which has a low hydrogen over-voltage when used in the electrolysis of water or aqueous solutions and which does not depend for its effectiveness on the presence of a coating containing a platinum group metal or an oxide thereof, such metals and oxides being relatively expensive.

Furthermore, we have found surprisingly that where an interim coating is applied by air plasma spraying at ambient pressure (hereinafter referred to for convenience as "APS") and the electrode coated, with the interim coating is heated in a non oxidizing atmosphere a cathode operating at low hydrogen over-voltage for a prolonged period of time, at least 12 months, can be prepared (hereinafter referred to for convenience as "durable electrode"). Such durable electrodes are also resistant to the effects of so-called "cell short-circuit stoppage", that is cell short-circuit stoppage has little adverse effect on the hydrogen over-voltage.

It is well known that cell short-circuit stoppage and "switch-off" separately lead to corrosion of cathodes, for example as described in EP 0,222,911 and EP 0,413,480 respectively. In EP 0,413,480 it has been suggested that the incorporation of metallic titanium and/or zirconium into the coating would reduce such corrosion --, -- and in EP 0,405,559--, -- it has been suggested that incorporation of nickel Misch metal, stabilized a Raney nickel coating against corrosion.

DETAILED DESCRIPTION OF THE PREFERRED EMBODIMENTS

Figure 1:
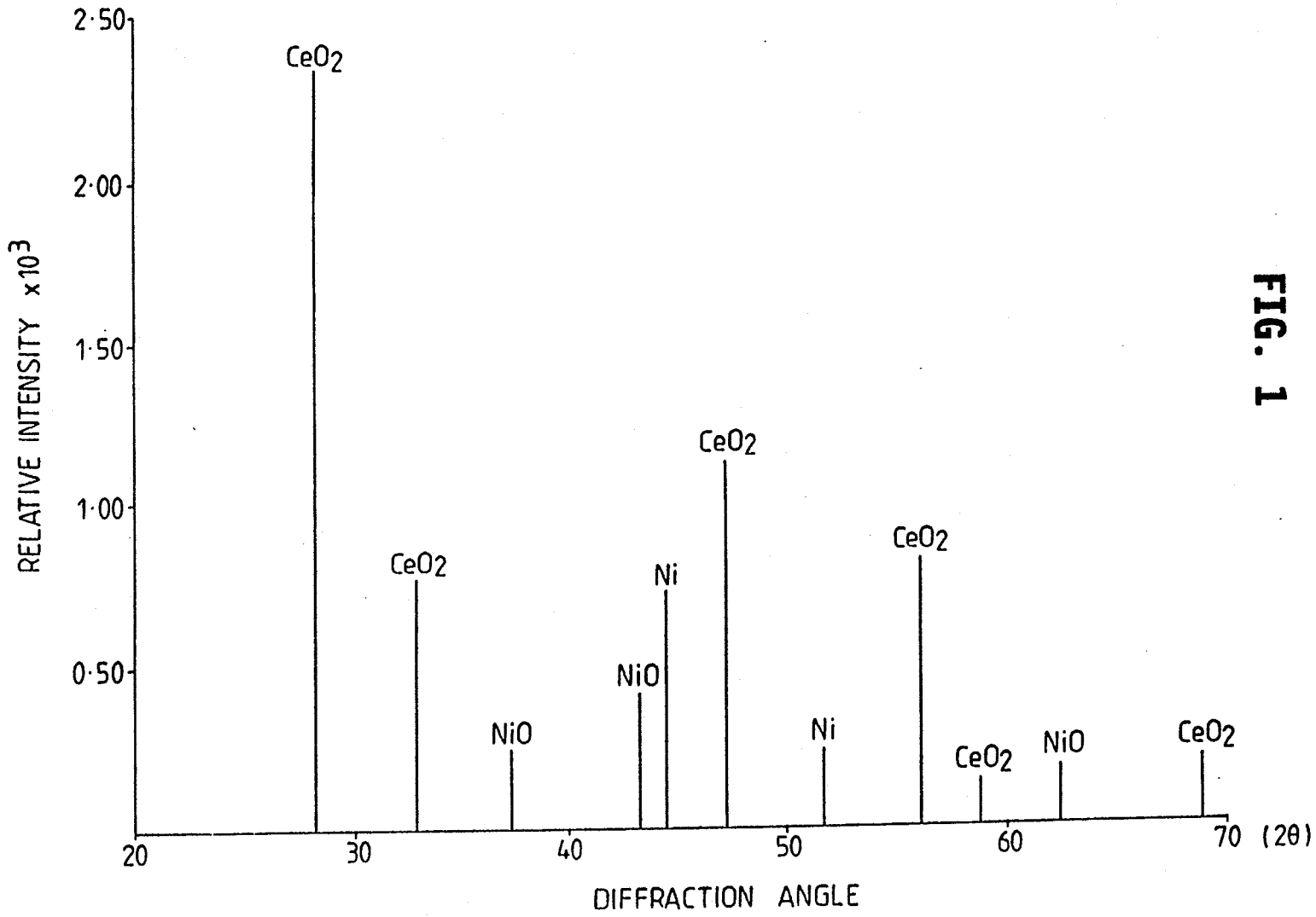
FIG. 1 illustrates an x-ray diffraction pattern of an electrode coating comprising cerium oxide, nickel and nickel oxide.

The first aspect of the present invention provides an electrode suitable for use as a cathode in an electrolytic cell which electrode comprises a metallic substrate and a coating thereon having at least an outer layer comprising a cerium oxide and at least one non-noble Group 8 metal. The electrode will hereinafter be referred to as a cathode.

In the electrode according to the first aspect of the present invention --,--; cerium oxide provides at least 10% and preferably at least 20% by x-ray diffraction (hereinafter referred to for convenience as "XRD") analysis of the coating.

We do not exclude the possibility that a small amount, say less than 10% by XRD of a non-noble Group 8 metal oxide may be present in the coating, for example NiO.

The electrode according to the first aspect of the present invention may be prepared by a process comprising the step of plasma spraying, preferably by APS an intermetallic compound of cerium and nickel.

The second aspect of the present invention provides a process for the preparation of an electrode as defined in the first aspect of the present invention which process comprises the steps of (A) applying an interim coating to the metallic substrate by APS and (B) heating the electrode bearing the interim coating in a non-oxidising atmosphere.

However, we do not exclude the possibility that the electrode according to the first aspect of the present invention may be prepared by (a) the APS of an intermetallic compound of cerium and at least one non-noble Group 8 metal onto the substrate, directly or (b) by heat treatment of known intermetallic coatings, or (c) thermal spraying of a mixture of cerium oxide and nickel.

A further aspect of the present invention provides an electrode for use as a cathode in an electrolytic cell which electrode comprises a metallic substrate and a coating thereon having at least an outer layer prepared by a process involving the step of APS an intermetallic compound of cerium and nickel and the further step of heating the electrode bearing the interim coating in a non-oxidizing atmosphere.

As examples of non-oxidizing atmospheres may be mentioned inter alia a vacuum, a reducing gas, for example hydrogen, or preferably an inert gas, for example argon, or mixtures thereof, for example heating in argon followed by vacuum treatment at elevated temperature.

The interim coating produced in Step A of the process according to the present invention typically comprises about 10% by XRD of an intermetallic compound, for example $CeNi_x$, wherein x has the meaning hereinafter ascribed to it. We have found that electrodes comprising such an interim coating often have a low hydrogen over-voltage.

Furthermore, we have found that low hydrogen over-voltage electrodes may be prepared by the low pressure plasma-spraying (hereinafter referred to for convenience as "LPPS") of an intermetallic compound of cerium and nickel. Coatings prepared by LPPS tend to comprise cerium oxide, non-noble Group 8 metal, preferably Ni, and at least 20% by XRD of an intermetallic compound of Ce and a non-noble Group 8 metal, for example $CeNi_x$.

We do not exclude the possibility that the interim coating in the preparation of the electrode according to the first aspect of the present invention may be prepared by an alternative melt-spraying process, for example low pressure plasma spraying; or baking, for example spray-bake; or composite plating, e.g. in a Watts bath heated to at least 300° C.

The interim coating comprises cerium oxide, a non-noble Group 8 metal and oxide thereof and an intermetallic compound of cerium and the non-noble Group 8.

We are aware of certain prior disclosures in which the use of intermetallic compounds as a low hydrogen over-voltage cathode coating has been described.

Doklady Akad Nauk SSSR 1984, vol 276 No 6 pp1424–1426, describes a study of the electrochemical properties of an electrode which is a copper or nickel screen to which a mixture of an intermetallic compound $LaNi_5$, $CeCo_3$, or $CeNi_3$ and a fluoropolymer is pressed and thermally treated under vacuum. The electrode of the present invention does not require the use of a fluoropolymer binder for the intermetallic compound. Furthermore, the electrochemical properties of the electrodes of the reference are said to be related to the electrode material as a whole since they will be influenced by the properties of the binder and its proportions.

In the proceedings of a symposium on Electrochemical Engineering in the Chlor-alkali and Chlorate Industries, The Electrochemical Society, 1988 pp184–194, there is described the use of a coated electrode in which the coating comprises $LaNi_5$ and a non-electroactive bonding agent or sintered particulate $LaNi_5$ or a sintered mixture of particulate $LaNi_5$ and Ni powder.

Journal of Applied Electrochemistry vol 14, 1984, pp107–115 describes a cathode for use in a chlor-alkali electrolytic cell in which the cathode comprises a steel or nickel substrate and a plasma-sprayed nickel coating on the substrate.

Published European patent application No. 0 089 141 describes a cathode which comprises a hydrogenated species of an $AB_n$ material including an $AB_5$ phase, wherein A is a rare earth metal or calcium, or two or more of these elements, of which up to 0.2 atoms in total may be replaced atom for atom by one or both of zirconium and thorium, and B is nickel or cobalt or both, of which up 1.5 atoms in total may be replaced atom for atom by one or more of copper, aluminium, tin, iron, and chromium, and particles of the $AB_n$ material not exceeding 20 μm in size being bonded by a metallic or electrically conductive plastic binder.

The cathode of the present invention comprises a metallic substrate. The substrate may be of a ferrous metal, or of a film-forming metal, for example, titanium. However, it is preferred that the substrate of the cathode is made of nickel or a nickel alloy or of another material having an outer face of nickel or nickel alloy. For example, the cathode may comprise a core of another metal, for example steel or copper, and an outer face of nickel or nickel alloy. A substrate comprising nickel or a nickel alloy is preferred on account of the corrosion resistance of such a substrate in an electrolytic cell in which aqueous alkali chloride solution is electrolyzed, and on account of the long term low hydrogen over-voltage performance of cathodes of the invention which comprises a substrate of nickel or nickel alloy.

The substrate of the cathode may have any desired structure. For example, it may be in the form of a plate, which may be foraminate, for example the cathode may be a perforated plate, or it may be in the form of an expanded metal, or it may be woven or unwoven. The cathode is not necessarily in plate form. Thus, it may be in the form of a plurality of so-called cathode fingers between which the anode of the electrolytic cell may be placed.

As it assists in the production of a cathode which operates with a low hydrogen over-voltage it is desirable that the substrate has a high surface area. Such a high surface area may be achieved by roughening the surface of the substrate, for example by chemically etching the surface and/or by grit-blasting the surface.

In the electrode according to the first aspect of the present invention --, --; the defined coating may be applied directly to the surface of the substrate. However, we do not exclude the possibility that the defined coating may be applied to an intermediate coating of another material on the surface of the substrate. Such an intermediate coating may be, for example, a porous nickel coating. However, the invention will be described hereinafter with reference to a cathode in which such an intermediate coating is not present.

The intermetallic compound which is to be air-plasma sprayed in the process according to the second aspect of the present invention must contain cerium. However, we do not exclude the possibility that it may contain one or more other metals of the lanthanide series, for example lanthanum itself, that is some of the cerium may be replaced by one or more other lanthanide metals. However, where such other metal of the lanthanide series is present in the intermetallic compound it should provide less than 2% by weight of the intermetallic compound and cerium should be present as the major amount of the total metal of the lanthanide series, including cerium.

The intermetallic compound which is to be air-plasma sprayed contains at least one non-noble Group 8 metal, that is at least one of iron, cobalt and nickel. Intermetallic compounds containing cobalt and/or nickel, particularly nickel, are preferred.

The intermetallic compound may contain one or more metals additional to cerium and non-noble Group 8 metals but such other metals, if present, will generally be present in a proportion of not more than 2% by weight.

The intermetallic compound may have an empirical formula $CeM_x$ where M is at least one non-noble Group 8 metal, x is in the range of about 1 to 5, and in which some of the cerium may be replaced by one or more other lanthanide metals as hereinbefore described.

The composition used for plasma spraying may be a neat intermetallic compound, for example $CeNi_3$ or a mixture of intermetallic compounds, for example $CeNi_3$ and $Ce_2Ni_7$, or an intimate mixture of a metal powder, preferably Ni, with an intermetallic compound, for example $Ce_2Ni_7$ to form, for example notionally $CeNi_{22}$, or a cerium/nickel alloy containing $CeNi_x$ phases wherein x is 1–5.

Typically the concentration of Ce in the intermetallic compound charged to the plasma spray gun is not more than about 50% by weight and it is often preferred that it is not less than about 10% by weight.

The relative amounts of a component in the outer layer can be determined from the peaks of the XRD analysis of the coating using the equation Relative amount of $Y$ =

(highest intensity diffaction peak height of $Y$) ÷

(sum of highest intensity diffaction peak height of all components)

It will be appreciated that amorphous material and/or low levels of a solid solution of cerium in nickel, not detectable by XRD analysis, may be present in the coatings.

The present invention is further illustrated by reference to FIG. 1. FIG. 1, shows an X-ray diffaction pattern of an electrode coating comprising cerium oxide, nickel and nickel oxide.

The interim coating produced in step A of the process of the present invention essentially comprises oxides of metals and Group 8 metal Typically, an amount up to about 10% by XRD say of intermetallic compound may be present in the interim coatings. The proportion of intermetallic compound in the coating decreases on heating in Steps B as shown by XRD analysis.

The precise temperature to be used in Step B of the process of the present invention depends at least to some extent on the precise method by which the coating is produced as will be discussed hereafter.

The coated electrode may be produced by direct application of particles of intermetallic compound to the metallic substrate. The particles of intermetallic compound may themselves be made by processes known in the art. For example, a mixture of the required metals in the proportions necessary for the production of the intermetallic compound may be melted and the molten mixture may then be comminuted and cooled rapidly to form a plurality of small particles of the intermetallic compound. The particles charged to the spray gun typically have a size in the range 0.1 μm to 250 μm, although particles having a size outside this range may be used, preferably 20–106 μ and more preferably 45–90 μm.

The temperature at which the particles are heated in the plasma-spraying step of process of the second aspect of the present invention may be several thousand °C. In general the power output from the plasma spray gun may be in the range 20 to 55 kW.

The mechanical properties and chemical/physical composition of the coating in the (durable) electrode according to the first aspect of the present invention are dependent on the length of time, the rate of heating and temperature used in Step B. It is preferably heated for less than 8 hours, more preferably above 1 hour. The temperature to which it is heated is preferably above 300° C. and less than 1000° C. and more preferably about 500° C. The typical rate of heating is between 1° and 50° C. per minute and preferably is in the range 10°–20° C./min.

The proportion of intermetallic compound in the coating decreases on heating in Step B as shown by X-ray diffraction analysis.

By "low pressure plasma spraying" we mean plasma spraying at low pressure, for example about 80–150 mbars, in an inert gas atmosphere, preferably argon. For example, the spraying chamber is evacuated and then back-filled with argon to the desired pressure.

In general the coating on the surface of the metallic substrate of the electrode of the first aspect of the present invention will be present at a loading of at least 20 $gm^{-2}$ of electrode surface in order that the reduced hydrogen overvoltage provided by the coating should last for a reasonable period of time. The length of time for which the reduced hydrogen over-voltage persists is related to the loading of the coating of intermetallic compound and the coating preferably is present at a loading of at least 50 $gm^{-2}$. The coating may be present at a loading of as much as 1200 $gm^{-2}$ or more.

It will be appreciated that the chemical compositions of the coating of the electrode prepared by the process according to the second aspect of the present invention will depend on inter alia the composition and form, for example size and shape, of the powder and on the plasma spraying conditions used, for example distance of gun from target and gun current.

The cathode of the invention may be a monopolar electrode or it may form part of a bipolar electrode.

The cathode is suitable for use in an electrolytic cell comprising an anode, or a plurality of anodes, a cathode, or a plurality of cathodes, and optionally a separator positioned between each adjacent anode and cathode. The separator may be a porous electrolyte permeable diaphragm or it may be a hydraulically impermeable cation permselective membrane.

The anode in the electrolytic cell may be metallic, and the nature of the metal will depend on the nature of the electrolyte to be electrolyzed in the electrolytic cell. A preferred metal is a film-forming metal, particularly where an aqueous solution of an alkali metal chloride is to be electrolysed in the cell.

The aforementioned film-forming metal may be one of the metals titanium, zirconium, niobium, tantalum or tungsten or an alloy consisting principally of one or more of these metals and having anodic polarization properties comparable with those of titanium.

The anode may have a coating of an electro-conducting electro-catalytically active material. Particularly, in the case where an aqueous solution of an alkali metal chloride is to be electrolyzed, this coating may for example consist of one or more platinum group metals, that is platinum, rhodium, iridium, ruthenium, osmium and palladium, or alloys of the said metals, and/or an oxide or oxides thereof. The coating may consist of one or more of the platinum group metals and/or oxides thereof in admixture with one or more non-noble metal oxides, particularly a film-forming metal oxide. Especially suitable electro-catalytically active coatings include platinum itself and those based on ruthenium dioxide/titanium dioxide, ruthenium dioxide/tin dioxide, ruthenium dioxide/tin dioxide/titanium dioxide, and tin dioxide, ruthenium dioxide and iridium dioxide.

Such coatings, and methods of application thereof, are well known in the art.

Cation permselective membranes as aforementioned are known in the art. The membrane is preferably a fluorine-containing polymeric material containing anionic groups. The polymeric material is preferably a fluoro-carbon containing the repeating groups.

$$[CF_2-CF_2]_m \text{ and } [CF_2-\underset{\underset{X}{|}}{CF}]_n$$

where m has a value of 2 to 10, and is preferably 2, the ratio of m to n is preferably such as to give an equivalent weight of the groups X in the range 500 to 2000, and X is chosen from $$A \text{ or } [OCF_2-\underset{\underset{Z}{|}}{CF}]_pA$$

where p has the value of for example 1 to 3, Z is fluorine or a perfluoroalkyl group having from 1 to 10 carbon atoms, and A is a group chosen from the groups: The $-SO_3H$
$-CF_2SO_3H$
$-CCl_2SO_3H$
$-X^1SO_3H_2$
$-PO_3H_2$
$-PO_2H_2$
$-COOH$ and
$-X^1OH$ or derivatives of the said groups, where $X^1$ is an aryl group. Preferably A represents the group $SO_3H$ or $-COOH$. Ion-exchange membranes derived from fluorine-containing polymeric materials which contain the repeating units $(CF_2-CF_2)_m$ and $(CF_2-CFX)_n$, wherein X, m, and n have the meanings hereinbefore ascribed to them, are sold under the tradename 'Nafion' by E I DuPont de Nemours and Co Inc when X is or contains an $-SO_3H$ group, and are sold under the tradename 'Flemion' by the Asahi Glass Co Ltd when X is or contains a $-COOH$ group.

The cathode of the invention is suitable for use in an electrolytic cell in which water or an aqueous solution is electrolyzed and in which hydrogen is produced by electrolysis and evolved at the cathode. The cathode of the invention finds its greatest application in the electrolysis of aqueous solutions of alkali metal chlorides, particularly aqueous solutions of sodium chloride, and in water electrolysis, for example in the electrolysis of aqueous potassium hydroxide solution.

The invention is illustrated by the following Examples in which, unless stated otherwise, each cathode comprised a grit-blasted nickel substrate.

In the Examples, the overvoltage was measured at a current density of 3 $kAm^{-2}$ in a 32% NaOH solution at 90° C. and the overvoltage of Grit Blasted Nickel ("GBNi") cathodes was taken as 350 mV. It was measured using the average measurements taken from three Luggin probes where the Luggin probes are disposed close (about 1 mm) to the electrode surface. A saturated calomel electrode was used as the reference electrode and the voltages obtained from the coated cathodes were compared with that of a GBNi cathode.

In the Examples, by "short" we mean the application of a shorting switch to the cell which allows the applied current to by-pass the cell and allows the cathode to return to its thermodynamic rest potential. This lack of a polarising voltage affords the possibility of corrosion occurring at the cathode coating. It will be appreciated that the ability of the cathode to withstand this change of condition in laboratory experiments is a prime indicator of its potential working durability in commercial chlor-alkali cells.

In the Examples, the coating loading was determined as weight increase per unit area of cathode.

EXAMPLES 1-20

Examples 6-17 illustrate durable electrodes according to the present invention (Table 3).

Examples 1-5 illustrate low over-voltage electrodes prepared by Step A of the process according to the present invention (Table 2).

Examples 18-20 are Comparative Tests.

In the Examples a grit-blasted nickel substrate was plasma-sprayed with a powder under essentially the following conditions:

| | |
|---|---|
| Argon flow | 40 SLPM |
| Hydrogen flow | 10 SLPM |
| Power feed rate | 25 g $min^{-1}$ |
| Current | 450 A |

In Examples 1-11 and 18, the powder charged to the spray-gun was a cerium/nickel intermetallic compound wherein the weight ratio of cerium:nickel was 50:50.

In Examples 12-17 and 19-20, the powders charged to the spray-gun had the compositions shown in Table 1

TABLE 1

| Example No. | Composition (% by weight) | |
|---|---|---|
| 12 | Cerium/nickel intermetallic | 45:55 |
| 13 | " | 35:65 |
| 14 | " | 19:81 |
| 15 | " | 19:81 |
| 16 | " | 10:90 |
| 17 | " | 10:90 |

TABLE 1-continued

| Example No. | Composition (% by weight) | |
|---|---|---|
| 19 | Cerium oxide:nickel | 76:24 |
| 20 | Mm/Ni intermetallic | 50:50 |

TABLE 2

| Example No. | Loading $gm^{-2}$ | Initial saving mV* | Final saving mV* |
|---|---|---|---|
| 1 | 70 | 286 | 138 |
| 2 | 130 | 312 | 171 |
| 3 | 300 | 268 | 109 |
| 4 | 309 | 288 | 147 |
| 5 | 1200 | 278 | 254 |

*vs. Grit blasted nickel coating

In Example 5, the cell was on load for 148 days, but not subjected to any shorts.

In Examples 6–15, 17, 18 and 20, the electrodes bearing interim coatings prepared under the aforementioned plasma-spraying conditions were subjected to one of the following heat treatments.

A: Argon atmosphere for 1 hour at 500° C. (Examples 6–10, 12–15, 17 and 20);

B: Hydrogen atmosphere for 1 hour at 500° C. (Example 11); or

C: air for 1 hour at 500° C. (Example 18)

In the Examples, the electrodes were subjected to 5 "shorts" (except Examples 5, 10 and 19 which were not "shorted").

TABLE 3

| Example No. | Loading $gm^{-2}$ | Initial mV saving* | Final mV saving* |
|---|---|---|---|
| 6 | 48 | 247 | 235 |
| 7 | 118 | 251 | 265 |
| 8 | 120 | 275 | 261 |
| 9 | 210 | 294 | 263 |
| 10 | 146 | 224 | 211 |
| 11 | 131 | 271 | 269 |
| 12 | 415 | 313 | 295 |
| 13 | 431 | 233 | 252 |
| 14 | 197 | 237 | 219 |
| 15 | 430 | 247 | 220 |
| 16 | 245 | 239 | 164 |
| 17 | 197 | 219 | 170 |
| 18 | 150 | 321 | 114 |
| 19 | 201 | 69 | 28 |
| 20 | 212 | 257 | 101 |

*vs. Grit blasted nickel coating

In Example 10, which is a Comparative Test in which the electrode was not subjected to any shorts, the cell was on load for 148 days.

The coatings on the electrode in certain of the Examples were analysed by XRD and the percentage compositions shown in Table 4 were observed.

TABLE 4

| Example No | % by XRD | | | |
|---|---|---|---|---|
| | $CeO_2$ | Ni | NiO | $CeNi_x$ |
| 1 | 61 | 19 | 12 | 8 |
| 6 | 73 | 21 | 6 | 0 |
| 11 | 77 | 23 | 0 | 0 |
| 18 | 71 | 16 | 13 | 0 |
| 12 | 70 | 27 | 3 | 0 |
| 13 | 54 | 43 | 39 | 0 |
| 15 | 26 | 72 | 2 | 0 |

TABLE 4-continued

| Example No | % by XRD | | | |
|---|---|---|---|---|
| | $CeO_2$ | Ni | NiO | $CeNi_x$ |
| 18 | 43 | 25 | 9 | 24 |

Example 18 illustrates the coating on an electrode prepared by low pressure plasma-spraying a cerium/-nickel intermetallic compound (50:50% by weight) without post heat treatment.

From Tables 3 and 4:

Examples 1–4 demonstrate the low initial over-voltage performance of interim coatings, and Example 5 demonstrates that if these interim coatings are not subjected to shorts they will continue performing with very little deterioration.

Examples 6–9 and 11 reveal that post-heat treatment in an argon and hydrogen atmosphere respectively increases durability.

Examples 12–15 reveal that reducing the cerium content of the intermetallic particles charged to the spraygun to 19% by weight has no significant effect on durability on a coated electrode prepared therefrom.

Example 1 and 6 reveal that useful electrodes can be obtained at coating loadings down to 50 $gm^{-2}$.

Examples 16 and 17 reveal that low cerium content reduces the durability of the coating even after heat treatment.

Example 18 shows that increasing the NiO content by heating the interim coating in air does not increase durability.

Example 19 shows that direct plasma spraying of CeO and Ni does not produce a low over-voltage coating.

Example 20 shows that increasing the proportion of other rare earths (in Misch metal) does not give durable coating.

We claim:

1. An electrode for use as a cathode in an electrolytic cell which electrode comprises:
   a metallic substrate; and
   a coating on the metallic substrate, the coating having at least an outer layer which comprises at least 10% cerium oxide by x-ray diffraction analysis and at least one non-noble Group 8 metal.

2. An electrode as claimed in claim 1 wherein $CeO_2$ provides at least 50% by x-ray diffraction analysis of the outer layer.

3. An electrode as claimed in claim 1 wherein the metallic substrate comprises nickel or a nickel alloy.

4. An electrode as claimed in claim 1 wherein the at least one non-noble Group 8 metal is at least one of cobalt and nickel.

5. An electrode as claimed in claim 1 wherein the outer layer is present at a loading of at least 50 $gm^{-2}$ 6. An electrode for use as a cathode in an electrolytic cell which electrode comprises:
   a metallic substrate: and
   a coating on the metallic substrate, the coating being prepared by a process comprising the steps of (A) applying an interim coating to the metallic substrate by plasma spraying an intermetallic compound comprising cerium and a non-noble Group 8 metal and (B) heating the electrode in a non-oxidizing atmosphere.

7. An electrolytic cell wherein at least one cathode comprises an electrode as claimed in claims 1 or 6.

8. A process for the electrolysis of water or an aqueous solution carried out in an electrolytic cell as claimed in claim 7.

* * * * *